US006227942B1

(12) United States Patent
Hoffman

(10) Patent No.: US 6,227,942 B1
(45) Date of Patent: May 8, 2001

(54) FERROFLUIDIC FINISHING

(75) Inventor: Steve E. Hoffman, Englewood Cliffs, NJ (US)

(73) Assignee: H-Semitran LLC, Boonton, NJ (US)

( * ) Notice: Subject to any disclaimer, the term of this patent is extended or adjusted under 35 U.S.C. 154(b) by 0 days.

(21) Appl. No.: 09/295,493

(22) Filed: Apr. 21, 1999

(51) Int. Cl.[7] ..... B24B 1/00

(52) U.S. Cl. ..... 451/36; 451/37; 451/104; 451/113

(58) Field of Search ..... 451/35, 36, 37, 451/113, 104

(56) References Cited

U.S. PATENT DOCUMENTS

| | | | | |
|---|---|---|---|---|
| 2,735,232 | | 2/1956 | Simjian | 51/7 |
| 4,821,466 | | 4/1989 | Kato et al. | 51/317 |
| 5,076,026 | * | 12/1991 | Mizuguchi et al. | 51/59 |
| 5,185,957 | * | 2/1993 | Mizuguchi et al. | 51/59 |
| 5,611,725 | * | 3/1997 | Imahashi | 451/104 |
| 5,931,718 | * | 8/1999 | Komanduri et al. | 451/36 |
| 5,957,753 | * | 9/1999 | Komanduri et al. | 451/36 |

* cited by examiner

*Primary Examiner*—Allen Ostrager
*Assistant Examiner*—William Hong
(74) *Attorney, Agent, or Firm*—Seidel Gonda Lavorgna & Monaco, PC

(57) ABSTRACT

A method for finishing a workpiece is disclosed. The method involves placing a ferrofluid finishing material into a vessel. The ferrofluid finishing material including a ferrofluid and a dispersed or colloidally suspended abrasive media. Placing a workpiece in the vessel so that the workpiece is submerged in the ferrofluid finishing material. A magnetic field is then applied in the vicinity of the vessel. The magnetic field produces an increase in viscosity of the ferrofluid. The increased viscosity generates a clamping force on the workpiece that results in increased surface resistance over the entire workpiece. Also, as the viscosity increases, it forces the workpiece to move relative to the ferrofluid. The relative motion between the abrasive media and the workpiece and increased surface resistance causes the abrasive media to finish the surface of the workpiece. In one embodiment of the invention, a plurality of magnetic fields are alternately generated within the vessel which result in back and forth relative motion between the abrasive media and the workpiece.

27 Claims, 4 Drawing Sheets

FERROFLUIDIC FINISHING

FIELD OF THE INVENTION

The present invention relates generally to the art of machining or surface finishing a workpiece, and, more specifically, to finishing the workpiece by contact with abrasive material in a ferrofluid material.

BACKGROUND OF THE INVENTION

Finishing operations are typically performed on a workpiece in order to alter the surface of the workpiece. The two primary processes for finishing are abrading and polishing. Abrasion refers to the removal of larger portions of the surface, primarily to alter the overall contour of the surface. Abrasion is often performed in a wet process, and may take the form of a grinding, deburring, aggressive smoothing or similar material removal operation. Polishing, on the other hand, refers to the removal of small portions of the surface of a workpiece, in a scratch like manner. The polishing process is intended to primarily alter the visible finish of the workpiece surface. Polishing is often performed in a dry process. The term "finishing" is generally used to refer to both surface abrading and surface polishing as described above.

It is not uncommon for a finishing operation t o incorporate both an abrasion process and an polishing process. Problems, however, may arise when switching from the wet abrasion process to the dry polishing processes. For example, the workpiece must be cleansed before the workpiece can be polished.

Another drawback with conventional automatic (non-manual) finishing operations is that they typically involve tumbling or vibrating the workpiece in a tub containing abrasive media which is not suitable for delicate articles such as semiconductor wafers.

A further problem associated with conventional finishing methods is the buildup of "fines", which are produced during the finishing process by attrition of the finishing media and/or material of the workpiece being finished. Buildup ofthe fines on the abrasive media tends to shorten the useful lifetime of the media. Also, due to their small size and/or tendency to adhere to the workpiece, the fines make cleaning of the finished workpiece difficult. The fines must also be disposed of, which can lead to environmental concerns.

Conventional finishing operations are also not suited for finishing irregular shaped surfaces. Recessed areas of the workpieces often cannot be finished to the same extent as exposed surfaces, thus leading to surface inconsistencies.

One prior art method for polishing or surface abrading irregular articles is described in U.S. Pat. No. 2,735,232. That method employs a mixture which consists of an abrasive powder, a magnetic powder and a liquid which may be any type of lubricating oil. After introducing a workpiece into the mixture, a two or three-phase magnetic field is applied to the mixture which causes the particles to move in small circular or spiral paths, abrading the surface ofthe workpiece as they contact it.

Another known method for grinding surfaces using a magnetic fluid containing abrasive grains is disclosed in U.S. Pat. No. 4,821,466. That method involves placing abrasive grains and an floating pad within a magnetic fluid. A magnetic field is applied to which creates a buoyant force under the abrasive grains and pad. The result is the formation of a high-density abrasive layer. The workpiece is then brought into contact with the abrasive layer and rotates by an external source to grind one surface of the workpiece. The main drawbacks with the system disclosed in U.S. Pat. No. 4,821,466 are the requirement of an external driving force to rotate the workpiece, and the inability to polish all the surfaces of the workpiece at the same time.

While these prior art finishing processes provide some degree of surface finishing for an irregularly shaped item, they are not very efficient and do not provide consistent results.

A need, therefore, exists for an improved finishing process which can be used to finish any shaped item quickly and efficiently.

SUMMARY OF THE INVENTION

The present invention relates to a process for ferrofluidic finishing of a workpiece. The process involves placing a workpiece in vessel that includes a ferrofluid medium saturated with abrasive particles. A magnetic field is applied to the vessel. The magnetic field causes the viscosity of the ferrofluid medium to increase which, in turn, produces clamping on the workpiece in all directions (i.e., increases surface resistance on workpiece) while pushing or forcing the workpiece to move away from the magnetic field. As the workpiece moves through the ferrofluid medium, it comes into contact with the abrasive particles which produce finishing of the workpiece surface.

The present invention has applicability to a wide variety of workpieces, such as irregularly shaped pieces and delicate or fragile pieces. In one embodiment of the invention, the present invention is used to finish the inside of a tubular workpiece.

The foregoing and other features and advantages of the present invention will become more apparent in light of the following detailed description of the preferred embodiments thereof, as illustrated in the accompanying figures. As will be realized, the invention is capable of modifications in various respects, all without departing from the invention. Accordingly, the drawings and the description are to be regarded as illustrative in nature, and not as restrictive.

DESCRIPTION OF THE DRAWINGS

For the purpose of illustrating the invention, the drawings show a form of the invention which is presently preferred. However, it should be understood that this invention is not limited to the precise arrangements and instrumentalities shown in the drawings.

DETAILED DESCRIPTION OF THE PREFERRED EMBODIMENTS

While the invention will be described in connection with one or more preferred embodiments, it will be understood that it is not intended to limit the invention to those embodiments. On the contrary, it is intended that the invention cover all alternatives, modifications and equivalents as may be included within its spirit and scope as defined by the appended claims.

Figure 1:
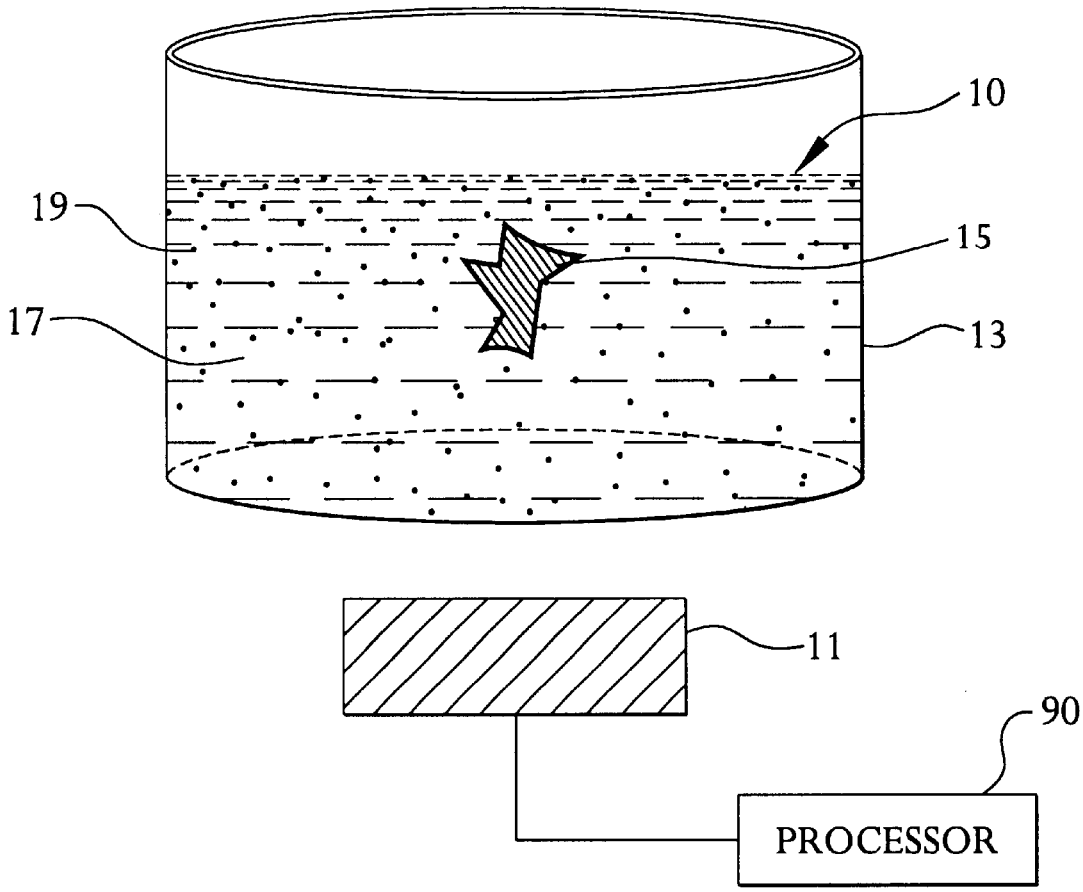
FIG. 1 is a diagrammatic view illustrating an embodiment of a device for preforming the method according to the present invention.

Referring now to the drawings, wherein like reference numerals illustrate corresponding or similar elements throughout the several views, FIG. 1 illustrates an embodiment of the present invention as it is contemplated for use in finishing a workpiece. The finishing process according to the present invention involves the use of a ferrofluid finishing material. A ferrofluid is, generally, a substantially stable colloidal suspension of magnetic particles in a liquid carrier. Ferrofluids are well known to those skilled in the art. A suitable ferrofluid medium for use in the present invention is a permanent or semi-permanent suspension of ferromagnetic particles in a liquid carrier. The magnetic particles are, in one embodiment of the invention, finely divided magnetite and/or gamma iron oxide particles. Other types of magnetic particles can also be used, such as chromium dioxide, ferrites, e.g., manganese-zinc ferrite, manganese ferrite, nickel ferrite elements and metallic alloys, e.g., cobalt, iron, nickel, and samarium-cobalt. The magnetic particles that are used in the present invention preferably range in size from about 10 to about 800 angstroms. More preferably, the particles range in sizes from about 50 to about 500 angstroms, with the average particle size being from about 100 to about 120 angstroms. The magnetic particles are typically coated with one or more layers of surfactant to prevent agglomeration in any particular liquid carrier.

A wide variety of liquid carriers may be employed in the ferrofluid medium of the present invention. A suitable liquid carrier is preferably inexpensive, easily evaporated, possesses low viscosity and is noncombustible. Examples of liquid carriers which can be used in a ferrofluid medium include water, silicones, hydrocarbons, both aromatic and aliphatic, such as toluene, xylene, cyclohexane, heptane, kerosene, mineral oils and the like, halocarbons, such as fluorocarbons, fluorinated and chlorinated ethers, esters and derivatives of $C_2$–$C_6$ materials, such as perfluorinated polyethers, esters that include di, tri and polyesters, such as azealates, phthalates, sebaccates, such as for example, dioctyl phthalates, di-2-theryhexyl azealates, silicate esters and the like.

A dispersant, which is typically a surfactant, may be employed to aid in the dispersion of the magnetic particles. Examples of such dispersants or surfactants include, but are not limited to, succinates, sulfonates, phosphated alcohols, long-chain amines, phosphate esters, polyether alcohols, polyether acids. The surfactant is typically present in a ratio of surfactant to magnetic particles from about 1:2 to about 10:1 by volume.

Preferably, the colloidal solution is neither coalesced nor precipitated under the influence of magnetic force, gravity, centrifugal force, etc. so that the magnetic fine particles are retained in a colloidal condition within the liquid carrier.

In the present, the magnetic particles make up upwards of about 20% by volume ofthe total ferrofluid composition. More preferably, the magnetic particles range from about 2 to about 15% by volume of the total ferrofluid composition.

The present invention also incorporates abrasive media or particles in the ferrofluid medium to form the ferrofluidic finishing material. The abrasive particles are preferably dispersed throughout the ferrofluid medium. The amount of abrasive particles that are contained within the ferrofluid will depend on the amount of finishing desired. In order to achieve a high amount of finishing, the ferrofluid is preferably saturated with dispersed abrasive particles. A suitable ferrofluid is rated at about 400 Gauss and has upwards of about 30% saturation.

The abrasive media preferably comprises particles formed of a mineral or ceramic which has a higher Mohs Scale value than the workpiece. Examples of suitable abrasives include, but are not limited to, garnet; emery; zirconium and titanium nitrides; zirconia; alumina; beryllium, boron, silicon, tantalum, titanium, tungsten and zirconium carbides; aluminum, tantalum, titanium and zirconium borides; boron and diamond. In one embodiment, the abrasive particle used in the material has an average size that falls within a range from about 1 micron to about 1 centimeter with a preferred range for the average particle size being from about 20 angstroms to about 1 millimeter.

Hence, as discussed above, the ferrofluid finishing material used in the present invention is a mixture of ferrofluid with dispersed or colloidally suspended abrasive particles. The ferrofluid finishing material is used in a finishing process to abrade and/or polish the surface of the workpiece.

The process will be better understood by reference to the accompanying figures. FIG. 1 is directed to one embodiment of the invention and illustrates a vessel or container 13 which contains a workpiece 15 within a ferrofluid finishing material 10. The ferrofluid finishing material 10 includes a ferrofluid 17 and abrasive media 19. A magnet 11 is located in close proximity to vessel 13 and, more preferably, adjacent to the bottom of the vessel 13. The workpiece 15 is submerged within the ferrofluid finishing material and will tend to settle within the finishing material 10 at or near the bottom of the vessel 13 when no magnetic field is applied to the vessel 13.

In order to finish the outside surface of the workpiece 15, the magnet 11 is energized so as to produce a magnetic field within the vessel 13. The magnetic field causes the viscosity ofthe ferrofluid 17 and/or the ferrofluid finishing material 10 to increase starting from a point near the magnetic field. As the viscosity increases, the ferrofluid finishing material 10 produces a positive pressure on all portions of the workpiece 15. This increases the surface resistance between the workpiece and the ferrofluid material 10. The increase in viscosity also forces the workpiece 15 to rise or move away from the magnetic field, i. e., the magnetic field produces repulsion of the non-ferrous workpiece. As the workpiece 15 moves through the ferrofluid finishing material, it contacts the abrasive media 19 within the material which, in turn, is being forced toward the workpiece 15 by the increased viscosity. Since the abrasive media 19 are contacting the entire surface of the workpiece, the media 19 abrades and/or polishes the entire workpiece surface, regardless of the actual direction of movement of the workpiece 15.

The increase in viscosity of the ferrofluid finishing material 10 also forces the abrasive media 19 to move through the finishing material in a direction away from the applied magnetic field. Depending on the abrasive material 19 properties and the characteristics of the workpiece 15, the magnetic field will typically cause the abrasive media 19 to travel through the finishing material 10 faster than workpiece 15, thereby causing increased finishing ofthe workpiece 15 as media 19 travels over the surface of workpiece 15.

The workpiece 15 will continue to move away from the magnetic 11 until the magnetic field is removed, at which point the workpiece will again settle toward the bottom of the vessel 13.

The present invention contemplates that the magnetic field would be applied and removed in a cyclic manner until a sufficient amount of finishing has occurred. A controller 90, such as a microprocessor, preferably controls energizing of the magnets. Factors, such as the strength of the magnetic field, size and hardness of the abrasive media 19, viscosity of the ferrofluid, and duration of magnetic field application, are selected to provide a desired finish. The viscosity of the ferrofluid can be modified by varying its formulation, the strength of the magnetic field applied thereto, its temperature or any combination thereof. As discussed above, a range of sizes of abrasive media can be used in the ferrofluid finishing material.

In one exemplary test of the present invention, a magnet with a lift force of 6000 pounds was placed adjacent to a container filled with Custom EMG 905S ferrofluid, sold by Ferrofluidics, Inc., Nashua, N.H. The ferrofluid was rated at 400 Gauss. A workpiece was placed within the fluid and the magnetic field was cycled on and off at a rate of 60 pulses per minute. After a period of time, the workpiece was removed and examined. The workpiece was noticeably finished on all surfaces.

The present invention can also be used to separate the workpiece and abrasive from the fines during the finishing process. For example, when a suitable amount of fines has developed in the ferrofluid finishing material or when the finishing operation is complete, a magnetic field can be applied to force the workpiece 15 and the abrasive particles 19 to move in a predetermined direction, away from the fines. The fines can then be separated out from the material without loss of the abrasive, and the workpiece 15 can be removed without contamination by the fines. For example, in a finishing operation that includes ferrofluid finishing material 10 made with a water carrier, after finishing of the workpiece is complete, a magnetic field is applied of such strength that the abrasives 19 and workpiece 15 are suspended in the ferrofluid. The fines can be forced to the top and skimmed off by energizing the magnets, or can be allowed to fall to the bottom of the vessel 13 where they can be drained off. A subsequent magnetic field can then be applied which separates the workpiece from the abrasives, permitting the workpiece 15 to be removed from the finishing mixture 10 and rinsed clean with water. This is especially advantageous when using expensive abrasives such as diamonds. For example, in a process that involves finishing of glass optics, a diamond suspension is used to finish the surface. The present invention can be used to easily and efficiently separate the glass optic workpiece from the diamond suspension.

Figure 2:
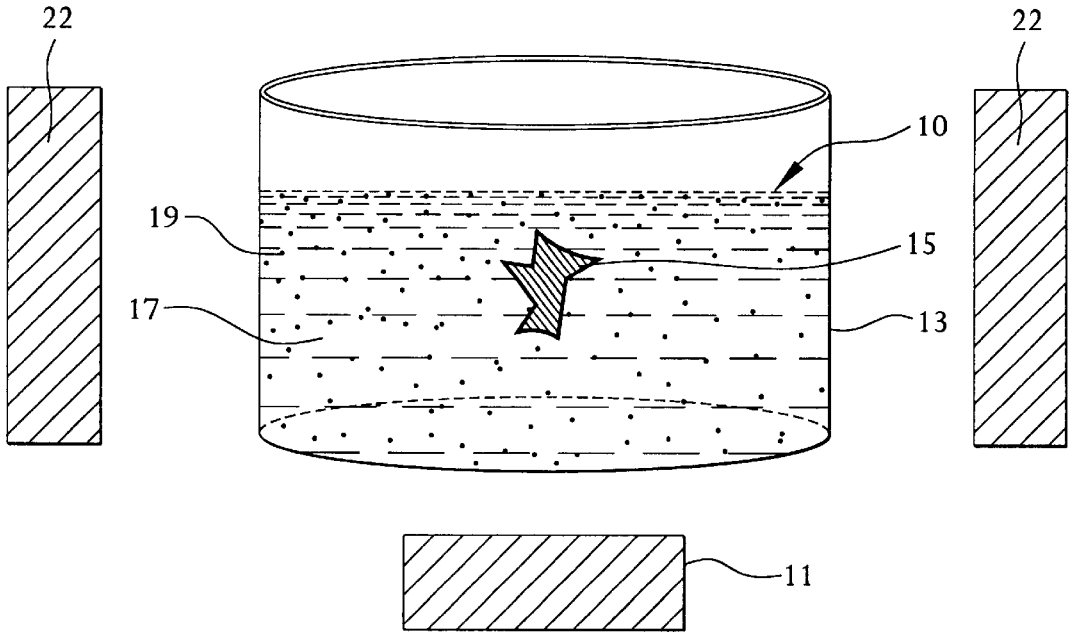
FIG. 2 is a diagrammatic view illustrating another embodiment of the present invention wherein multiple magnets are utilized.

FIG. 2 illustrates another embodiment ofthe invention wherein additional magnets 22 are mounted adjacent to the vessel 13. The magnets are positioned on the sides of the vessel 13. The workpiece 15 is submerged within the finishing material 10. A magnetic field is applied by magnet 11 causing the workpiece 15 to become suspended. Magnets 22 are then energized, creating magnetic fields on either side of the workpiece 15. The magnets 22 are preferably alternately energized to cause the workpiece 15 to move back and forth sideways through the finishing material 10. While the magnets 22 are shown as arranged horizontally with respect to the vessel 13, it is also contemplated that one or more additional magnets can be positioned across the top of the vessel 13 (see magnet 24 in FIG. 3) and operated in a complementary manner with the lower magnet 11 to move the workpiece back and forth vertically through the material 10. It should be readily apparent that alternate orientations of the magnets with respect to the vessel 13 are also possible within the context of the present invention.

For example, a series of magnets may be placed around the circumference of the vessel 13 and operated so as to cause the workpiece 15 to move in a circular manner or to move back and forth in an arcuate direction.

Figure 3:
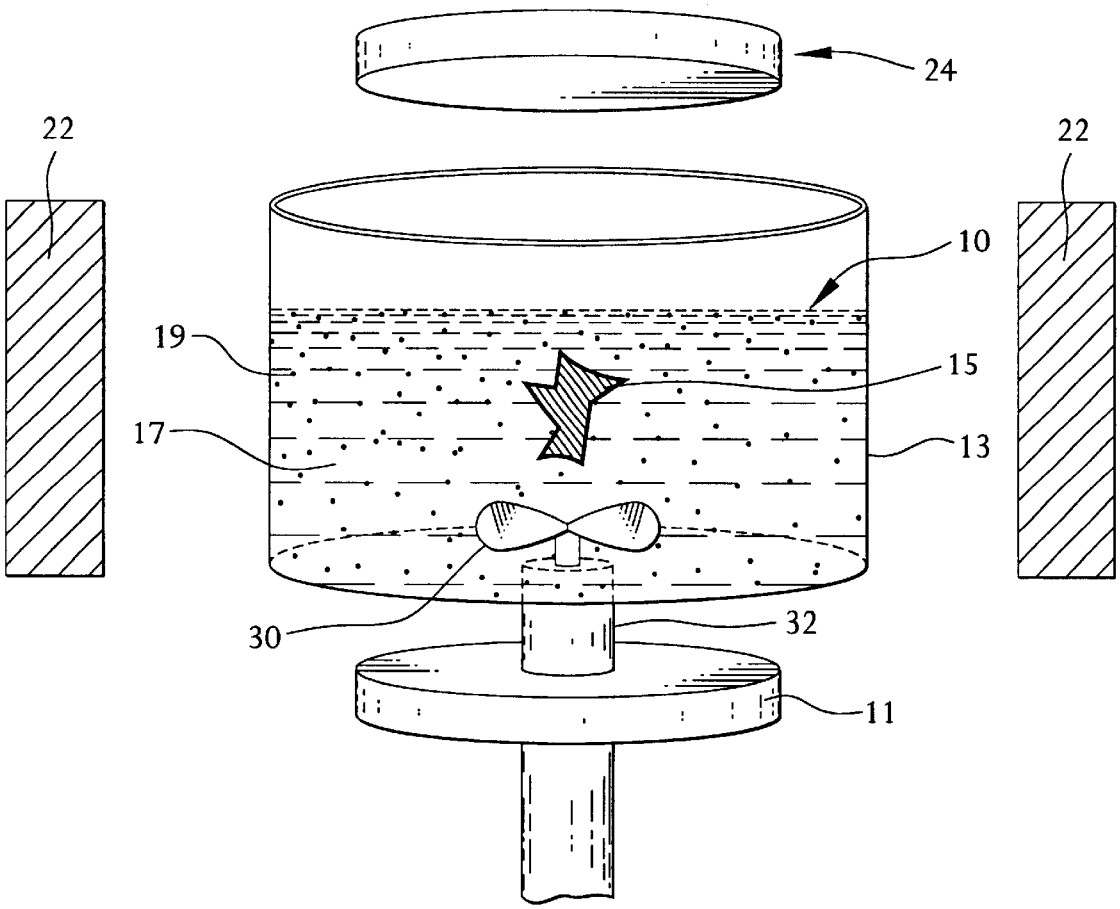
FIG. 3 is a diagrammatic view illustrating another embodiment of the present invention which incorporates a spinning vessel for containing the ferrofluid finishing material.

Referring now to FIG. 3, another embodiment ofthe invention is depicted which includes a shaft 32 that connects the vessel 13 to a motor (not shown). The workpiece 15 is submerged in the finishing material 10. A magnetic field is applied to the lower magnet 11 to suspend the workpiece within the ferrofluid mixture 10. The motor rotates shaft 32 which, in turn, rotates the vessel 13. As discussed above, additional magnets 22, 24 are preferably positioned on the top, side and/or around the circumference of the vessel 13. In this embodiment, the magnets 22, 24 are preferably energized at the same time, so that the magnetic fields that are generated push the workpiece 15 to the center of spinning vessel 13. The magnetic fields are then removed or reduced allowing the centrifugal force to drive the workpiece 15 and/or the abrasive media 19 radially outward. As the workpiece 15 moves within the ferrofluid finishing material 10, the abrasive particles 19 finish the surface of the workpiece 15. Application of the magnetic field to the magnets 22, 24 is cycled to move the workpiece 15 back and forth through the finishing material.

It is also contemplated that a propeller 30 or similar mixing or agitation device may be mounted within the vessel 13. The agitation device can be used to impart motion to the workpiece and/or the abrasive particles. This can be particularly advantageous for a ferrofluid finishing material that includes large abrasive media 19. The media can be projected into the solution by propeller 30 before applying a magnetic field. It should be readily apparent that in order to produce sufficient agitation, there should be relative motion between the propeller 30 and the vessel 13. Hence, if the shaft 32 is used to rotate the vessel 13, agitation can be produced by mounting the propeller 30 so that it does not move.

In another embodiment of the invention, the vessel 13 containing the workpiece 15 can be vibrated to add additional motion to the workpiece 15 relative to the finishing material 10.

Figure 4:
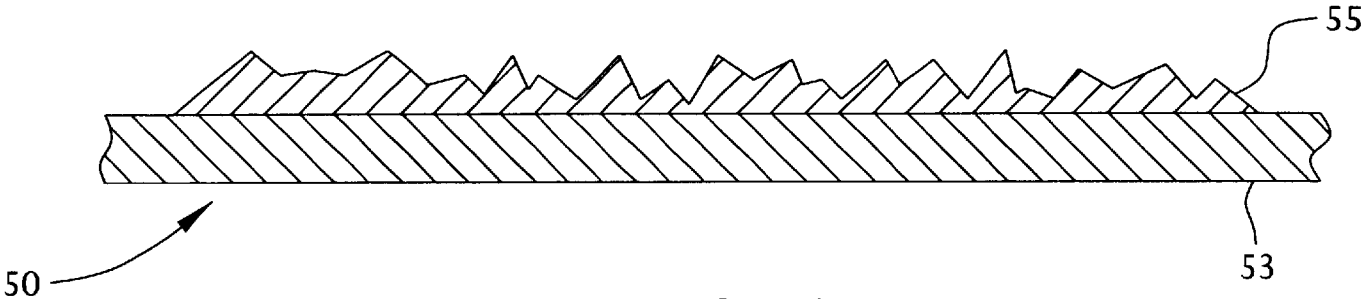
FIG. 4 is a illustrative representation of the cross-section of a semiconductor wafer that can be finished using the present invention.

FIG. 4 is an illustrative cross-sectional representation of a semiconductor wafer 50 that includes a silicon wafer 53 and aluminum layer 55. The aluminum layer 55 typically deposited on silicon layer 55 using a process, such as photolithography, which often results in a rough surface. It is desirable, however, that each layer of the wafer 50 have a smooth uniform surface. Conventional machining processes use rotating, abrasive disks to grind a smooth surface. These machining processes must be carefully tailored to prevent damage to the delicate wafer. The present invention provides a novel method for surface finishing an aluminum layer on a semiconductor wafer.

It is preferable in a semiconductor finishing operation according to the present invention that the ferrofluid finishing material 10 includes abrasive media 19 which is harder than aluminum but softer than silicon, such as opal. This produces a uniform deposition surface on the aluminum/silicon semiconductor wafer 50. When the finishing material 10 is passed over the surface of the wafer 50 in the presence of a magnetic field, the abrasive 19 finishes only the softer aluminum layer 55 leaving the harder silicon layer 53 unaffected.

Figure 5:
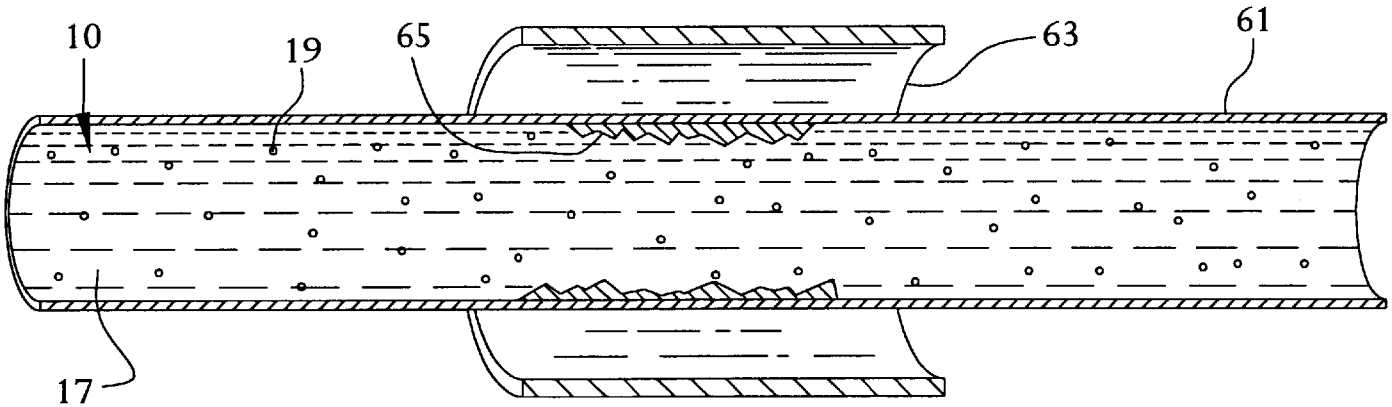
FIG. 5 is a diagrammatic view illustrating an embodiment of the present invention for finishing the inner surfaces of a tubular pipe.

FIG. 5 depicts a further embodiment of the invention wherein the finishing operation of the present invention is used to finish the inside surface of a tubular workpiece 61 or to remove an internal obstruction formed on the inner wall of the tube 61. The obstruction or rough surface is indicated by the numeral 65. A magnet 63 is mounted around the outside of the tubular workpiece 61, in the vicinity of the area of interest.

During the finishing operation, a ferrofluid finishing material 10 is channeled or forced though the tube 61. As it flows through the tube 61, the material 10 passes through a magnetic field produced by the magnet 63. At this point, the abrasive properties of the finishing material 10 are increased, owing to the increase in viscosity, resulting in abrasion of the obstruction and/or surface 65 of the tube 61 as the finishing material passes. The ferrofluid finishing material 10 may be channeled through or reciprocated within the tube 61.

Alternatively, the magnet 63 may be part of a magnetic array which is capable of producing a variable magnetic field. When tube 61 is filled with finishing material 10, the magnetic field is controlled so as to force the finishing material to circulate within the tube, thus altering the surface 65 even when flow is stopped. In addition the composition of the finishing maternal, pressure, flow rate, and temperature may be varied to attain the desired surface characteristics.

It is also contemplated that the workpiece may be magnetically tagged so that its orientation in the finishing material can be controlled by the applied magnetic force. Tagging allows for greater control of the finishing process. For example, if additional magnets are mounted about the periphery of the vessel 13, selected magnets can be energized depending on the orientation of the workpiece to provide optimum surface finishing. The magnetic tag may be incorporated into a masking element which is used to mask part of the workpiece 15. A processor 90 would be used to detect the orientation of the workpiece 15 and control application of the magnetic fields.

While the present invention has been described with the workpiece 15 being capable of moving within the ferrofluid finishing material 10, it is also contemplated that the workpiece may be fixed within the vessel 13 and the finishing material 10 forced past the surface of the workpiece 15. Alternatively, the workpiece 15 may be moved within the finishing material by an external means such as with a rod after the magnetic field is applied and the ferrofluid material becomes viscous. Furthermore, the present invention is not limited to one workpiece 15. On the contrary, a plurality of workpieces may be placed within a single vessel if desired.

A wide variety of magnets may be utilized in the present invention. For example, the magnet may be a permanent magnet, such as a ferromagnet, an electromagnet, a superconducting magnet, or any combination thereof. These types of magnets and their operation all well known in the art and, therefore, no further discussion is needed.

Also, while the ferrofluid has been described as a permanent colloidal suspension, similar results can be achieved from a temporary suspended solution, provided the invention is practiced while the ferrofluid is in the state of suspension.

The present invention as described above provides a novel process for quickly and consistently finishing a workpiece. The increase in the viscosity of the ferrofluid causes by the magnetic field produces a positive pressure on the workpiece by increasing the surface resistance on all parts of the workpiece and forcing the workpiece to move relative to the abrasive particles. The increase in surface resistance all around the workpiece causes the abrasive particles to contact the workpiece, regardless of the direction that the workpiece is moving. This transition state has the potential to create finishing in all directions. As such, the present invention improves the resulting finish ofthe workpiece. The methods and compositions of this invention can also be used in combination with current finishing methods known in the art such as a centrifugal disk finisher.

Although the invention has been described and illustrated with respect to the exemplary embodiments thereof, it should be understood by those skilled in the art that the foregoing and various other changes, omissions and additions may be made therein and thereto, without parting from the spirit and scope of the present invention.

What is claimed is:

1. A method for finishing a workpiece comprising the steps of:

placing a ferrofluid finishing material in a vessel, the ferrofluid finishing material including a ferrofluid and a colloidally suspended abrasive media;

placing a workpiece in the vessel; and applying at least one magnetic field in the vicinity of the vessel to produce an increase in viscosity of the ferrofluid, the increased viscosity producing relative motion between the abrasive media and workpiece such that the abrasive media finishes the surface of the workpiece.

2. The method of claim 1 wherein at least two magnetic fields are applied in the vicinity of the vessel, the two magnetic fields being on substantially opposite sides of the vessel and applied in an alternating manner.

3. The method of claim 1 wherein at least two magnetic fields are applied, one magnetic field being applied near the bottom of the vessel to cause the workpiece to rise within the ferrofluid finishing material, and the other magnetic field being applied to the side of the vessel.

4. The method of claim 1 further comprising the steps of removing the magnetic field then reapplying the magnetic field, the application and removal of the magnetic field producing back and forth relative motion between the abrasive media and the workpiece.

5. The method of claim 1 wherein the vessel is rotatable, the method further comprising the step of rotating the vessel, and wherein at least two magnet fields are applied, one magnetic field being applied in the vicinity of the bottom of the vessel causing the workpiece to rise, the other magnetic field being applied to the side of the vessel causing the workpiece to move toward the center of the vessel, the method further comprising the step of removing the magnetic field on the side of the container and permitting the centrifugal force to move the workpiece radially outwardly from the center of the vessel.

6. The method of claim 1, further comprising the steps of attaching the workpiece to an external device which is arranged to move the workpiece relative to the vessel;

and causing said external device to move the workpiece relative to the vessel while said workpiece is in the vessel and while applying said at least one magnetic field.

7. The method of claim 1 wherein the magnetic field is produced by at least one permanent magnet, and wherein the step of applying a magnetic field involves energizing the at least one permanent magnet.

8. The method of claim 1 wherein the magnetic field is produced by at least one electromagnet, and wherein the step of applying a magnetic field involves energizing the at least one electromagnet.

9. The method of claim 1 wherein the magnetic field is produced by at least one superconducting magnet, and wherein the step of applying a magnetic field involves energizing the at least superconducting magnet.

10. The method of claim 1, further comprising the steps of fixing the workpiece relative to the vessel and forcing the abrasive media to move past the workpiece by use of the magnetic field.

11. The method of claim 1, further comprising the step of placing a plurality of workpieces in the vessel.

12. The method of claim 1, further comprising the step of placing a semiconductor wafer with an aluminum portion and a silicon portion in said vessel as said workpiece, and providing a ferrofluidic material which includes abrasive media having particles which are harder than aluminum and softer than silicon.

13. The method of claim 12 wherein the abrasive material is opal.

14. The method of claim 1 wherein before the step of placing the ferrofluid finishing material in a vessel, the method comprises the steps of:

providing a vessel for containing a liquid, the vessel having a magnet located adjacent to the bottom of the vessel; and providing a controller electrically connected to the magnet and adapted to energize the magnet to create a magnetic field.

15. A method for finishing a workpiece, comprising the steps of:

(a) submerging a workpiece in a ferrofluid finishing material that includes a ferrofluid and an abrasive media; and (b) applying an initial magnetic field to substantially suspend the workpiece in the ferrofluid finishing material;

and while the workpiece is suspended carrying out the steps of:

(c) applying a first magnetic field to the ferrofluid finishing material to cause the workpiece to move in a first direction with respect to the vessel, the first magnetic field causing the viscosity of the ferrofluid finishing material to increase;

(d) removing the first magnetic field;

(e) applying a second magnetic field to the ferrofluid finishing material to cause the workpiece to move in a second direction with respect to the vessel which is different from the first direction, the second magnetic field causing the viscosity ofthe ferrofluid finishing material to increase; and (f) removing the second magnetic field.

16. A method for finishing a workpiece comprising the steps of:

(a) submerging a workpiece in a ferrofluid finishing material that includes a ferrofluid and an abrasive media;

(b) applying a first magnetic field to the ferrofluid finishing material to cause the workpiece to move in a first direction with respect to the vessel, the first magnetic field causing the viscosity ofthe ferrofluid finishing material to increase;

(c) removing the first magnetic field;

(d) applying a second magnetic field to the ferrofluid finishing material to cause the workpiece to move in a second direction with respect to the vessel which is different from the first direction, the second magnetic field causing the viscosity of the ferrofluid finishing material to increase; and (e) removing the second magnetic field.

17. The method of claim 16 wherein after step (e), steps (b) through (e) are repeated.

18. An apparatus for surface finishing a workpiece, the apparatus comprising:

a vessel;

a magnet located adjacent to the bottom of the vessel;

a ferrofluid finishing material located within the vessel, the ferrofluid finishing material including a ferrofluid and a colloidally suspended abrasive media; and a controller electrically connected to the magnet and adapted to alternately energize and deenergize the magnet to create and remove a magnetic field in the vicinity of the vessel for varying the viscosity of the ferrofluid, the variation in the viscosity adapted to produce relative motion between the abrasive media and a workpiece such that the abrasive media finishes the surface of the workpiece.

19. A method for finishing a semiconductor wafer, the semiconductor including an aluminum portion and a silicon portion, the method comprising the steps of:

submerging the semiconductor wafer in a finishing material that includes a ferrofluid and colloidally suspended abrasive media, the abrasive media including particles that are harder than aluminum and softer than silicon; and applying a magnetic field to the finishing material to cause the abrasive media to contact the surface of the semiconductor wafer.

20. A method for finishing a workpiece comprising the steps of:

placing a ferrofluid finishing material in a vessel, the ferrofluid finishing material including a ferrofluid and a dispersed or colloidally suspended abrasive media;

placing a workpiece in the vessel; and applying at least two magnetic fields in the vicinity of the vessel to produce an increase in viscosity of the ferrofluid, the increased viscosity producing relative motion between the abrasive media and workpiece such that the abrasive media finishes the surface of the workpiece, one magnetic field being applied near the bottom of the vessel to cause the workpiece to rise within the ferrofluid finishing material, and the other magnetic field being applied to the side of the vessel.

21. A method for finishing a workpiece comprising the steps of:

placing a ferrofluid finishing material in contact with a workpiece, the ferrofluid finishing material including a ferrofluid and a colloidally suspended abrasive media;

applying at least one magnetic field in the vicinity of the workpiece, the magnetic field producing an increase in viscosity of the ferrofluid, the increased viscosity producing relative motion between the abrasive media and workpiece such that the abrasive media alters the surface of the workpiece through contact.

22. The method of claim 21, wherein the workpiece is tubular in shape and wherein the step of placing the ferrofluid finishing material in contact with the workpiece comprises placing the ferrofluid finishing material in contact with the interior of the workpiece.

23. The method of claim 22 for finishing a workpiece that has an obstruction on its interior surface, wherein said step of applying the magnetic field causes the abrasive media to alter the interior surface by removing the obstruction.

24. The method of claim 21, comprising applying the at least one magnetic field in an oscillatory manner to produce relative back and forth movement between the surface of the workpiece and the abrasive particles.

25. A method for finishing a workpiece comprising the steps of:

placing a ferrofluid finishing material in a vessel, the ferrofluid finishing material including a ferrofluid and a dispersed or colloidally suspended abrasive media;

placing a workpiece in the vessel; and applying at least one magnetic field in the vicinity of the vessel to cause the workpiece to move within the ferrofluid finishing material, and to produce relative motion between the abrasive media and workpiece such that the abrasive media finishes the surface of the workpiece.

26. The method of claim 25, further comprising the step of applying at least two magnetic fields, one magnetic field being applied near the bottom of the vessel to cause the workpiece to rise within the ferrofluid finishing material, and the other magnetic field being applied to the side of the vessel.

27. The method of claim 25, further comprising applying two said magnetic fields on substantially opposite sides of the vessel in an alternating manner.

* * * * *